US005134393A

United States Patent [19]

Henson

[11] Patent Number: 5,134,393

[45] Date of Patent: Jul. 28, 1992

[54] TRAFFIC CONTROL SYSTEM

[76] Inventor: H. Keith Henson, 1794 Cardel Way, San Jose, Calif. 95124

[21] Appl. No.: 502,996

[22] Filed: Apr. 2, 1990

[51] Int. Cl.[5] ..... G08G 1/01

[52] U.S. Cl. ..... 340/933; 180/167; 340/905; 364/436

[58] Field of Search ..... 340/907, 917, 932, 933, 340/901, 903, 905; 180/167, 168, 169, 170; 364/436, 437, 438

[56] References Cited

U.S. PATENT DOCUMENTS

| | | | |
|---|---|---|---|
| 1,824,572 | 9/1931 | Roberts . | |
| 2,632,153 | 3/1953 | Swanger . | |
| 3,152,315 | 10/1964 | Rogers . | |
| 3,188,927 | 6/1965 | Woods | 94/1.5 |
| 3,302,168 | 1/1967 | Gray et al. . | |
| 3,529,284 | 9/1970 | Villemain . | |
| 3,544,959 | 12/1970 | Hawks | 340/932 |
| 3,593,262 | 7/1971 | Spencer . | |
| 3,750,099 | 7/1973 | Proctor | 340/932 |
| 3,790,780 | 2/1974 | Helmcke et al. | 340/903 |
| 3,840,848 | 10/1974 | Marshall et al. | 340/933 |
| 3,872,423 | 3/1975 | Yeakley . | |
| 4,348,652 | 9/1982 | Barnes et al. | 340/905 |
| 4,401,181 | 8/1983 | Schwarz | 340/905 |

FOREIGN PATENT DOCUMENTS

| | | | |
|---|---|---|---|
| 0135740 | 4/1985 | European Pat. Off. | 340/905 |

*Primary Examiner*—Jin F. Ng
*Assistant Examiner*—Brent A. Swarthout
*Attorney, Agent, or Firm*—Harrison & Egbert

[57] ABSTRACT

A traffic control system comprising a traffic control strip extending along a traffic flow lane and having a plurality of luminants extending at spaced intervals in a linear fashion along the traffic control strip, a plurality of detectors positioned on the traffic control strip so as to detect vehicles passing in proximity thereto, a processor connected to the detectors and to the luminants in the traffic control strip. The traffic control strip is a clear strip of material rigidly affixed to the surface of the traffic lane. The traffic control strips include the electrical transmission lines extending from the detectors and the luminants to the processors. The luminants are a plurality of LEDs spaced in a linear array. The detector is an infrared transmitter/detector positioned at regular intervals along the traffic control strip. Vehicles passing along the traffic control strip may contain suitably positioned infrared transmitters and receivers for communication with the traffic control computers.

13 Claims, 3 Drawing Sheets

TRAFFIC CONTROL SYSTEM

TECHNICAL FIELD

The present invention relates to traffic control systems. More particularly, the present invention relates to apparatus and methods for control of speed and spacing of vehicles along a traffic lane, especially during conditions of high traffic flow.

BACKGROUND ART

It will be a long time, decades at least, before computer control technology is adequate to build contained, on-board systems which can be trusted to do a better job than humans do with the incredibly complex task of driving in traffic. Even if technology were up to the task, it would take a decade or more to replace most of the privately owned motor vehicles. But there is a great need now for a technology which could improve traffic flow on existing roads and freeways. Such a technology would alleviate the need to build freeways in places where there is no room for them, and significantly reduce pollution since a large fraction of vehicle pollution comes from low speed or idling engines.

While current computer/electronic technology is not up to the task of driving vehicles, advances in this field over the last decade or two have been significant. A simple way to think about the changes which are continuing to revolutionize the electronics industry is that striping roads with four-function calculators, instead of paint, would only add ten dollars to fifteen dollars a foot (fifty thousand to seventy-five thousand dollars per mile) to the costs of a lane. Freeway lane expansion (where possible) costs at least a million dollars a mile. If striping lanes with four-function calculators improved traffic flow even ten percent, it would be cost effective.

It is desirable to provide detailed speed and spacing instructions to drivers by means of a computer controlled, sequentially activated, lighted section of a string of lights in a strip glued near the center of each lane of a freeway or road. This system would provide sensitive position feedback information to drivers from computers able to optimize overall traffic flow, and thus permit higher levels of traffic than are possible for unaided drivers. Among the functions of such a strip would be to delay the onset of "emergent" phenomenon (of which massive slowdowns and standing waves are examples) at traffic levels near saturation, that is levels where traffic flow becomes unstable. A best guess from observation of traffic in collapse or near collapse conditions is that a fifty percent or greater improvement over the level E service of 1800 to 2000 vehicles per lane per hour might be possible.

Various U.S. patents in the past have dealt with techniques for providing control of traffic.

U.S. Pat. No. 3,872,423, issued on Mar. 18, 1975, to J. Yeakley, describes a pacer system and a method of spacing moving vehicles along the traffic lane. This provides a "pacing signal" for selectively displaying an indicator which is timed with respect to other means so as to provide a "continuous signal" corresponding to the proper vehicular speed along the lane. By keeping pace with the signal as it appears, a vehicle can be maintained at a programmed speed. The vehicles can also be maintained at a substantially fixed distance from a vehicle in front and a vehicle in back. The signals are programmed for each indicator so as to space successive vehicles apart at a distance corresponding to the programmed speed for the vehicles and the time interval from one displayed pacing signal to the next. A plurality of lights are built along the side of the highway so as to provide the pacing signals. In this invention, there is no feedback interaction with the individual vehicle travelling along the highway.

U.S Pat. No. 3,750,099, issued on Jul. 31, 1973, to R. E. Proctor describes a different type of pacing system. This invention is comprised of a stationary strip of equally spaced bars transverse to the direction of traffic and suitable means for intermittently illuminating these bars simultaneously at a selected frequency. The frequency selected is designed to produce a stroboscopic effect on the observer moving parallel to the strip of bars. Only at a predetermined velocity will the bars appear to be motionless. At a velocity near, but greater than the predetermined velocity, these bars will appear to the observer in such a manner that he is overtaking the bars. At a velocity near, but less than the predetermined velocity, it appears to the observer that the bars are moving away from him. Once again, this provides a stroboscopic pacing system but without the feedback from the vehicle.

Another traffic pacing system is also shown in U.S. Pat. No. 3,188,927 issued on Jun. 15, 1965, to A. M. Woods. This device also uses a system of dots that are ingrained into the highway and illuminated so as to allow the moving vehicle to remain a proper distance behind another vehicle. These lights in the roadway are arranged to illuminate at predetermined intervals. This is a rather simple invention used for indicating proper spacing of vehicles.

U.S. Pat. No. 3,529,284, issued on Sep. 15, 1970, to C. A. Villemain shows a traffic control system. This is a sequential series of traffic control lights that are mounted on the roadway so as to be visible from a single lane and by a single vehicle only. These lights are sequentially energized with green, preferably in intermittent flashes, to form a progressive wave of blinking lights for the control of individual vehicles travelling in a group at a speed determined by the progressive blinks. The cycling of the control lights can vary, in accordance with the number of vehicles and their maximum speed, as controlled by computers which count the number of vehicles intended to enter a given controlled roadway or lane. Once again, there is no feedback between the progression of the signals and the location of the vehicles on the roadway.

U.S. Pat. No. 3,593,262 describes a traffic control system for a merge junction between first and second vehicular paths. This provides a warning to the vehicles ahead. It is very Similar to the kind of block control used on railroads. It could be quite useful for fog conditions. However, it does not function for positive position control.

The present invention proposes to glue on roadways an amount of electronic circuitry about equal to a continuous string of four function calculators, and to dedicate substantial computer resources to controlling those circuits.

The present invention is predicated on the following: First, people generally do a good job of driving vehicles and could be trusted to follow directions from computer system directing traffic. This is only an extension of our long experience with traffic lights. Second, the cost of dedicating what is now a large personal computer per lane per mile is not excessive compared to the cost of pouring concrete. Third, visual and infrared solid state devices are sufficiently long lived, inexpensive, and rugged enough that they could be encapsulated in clear plastic and glued to roads with the expectation that they would last for some years--even with heavy trucks running over them.

With the above in mind, the object of the present invention is to provide substantial improvements (estimated at 50 to 100%) in traffic flow at very high traffic levels, particularly at those levels of traffic which result in "stop and go" driving conditions.

It is an object of the present invention to provide a traffic control system that, through visual signals to the drivers, or directly, through interaction with vehicle cruise controls, has control over the longitudinal location of every vehicle in the traffic stream.

It is another object of the present invention to provide a traffic control system that has bidirectional interaction with the drivers of individual vehicles on the highway.

It is still another object of the present invention to provide a traffic control system that can monitor highway conditions locally as well as far ahead and adjust traffic speed and spacing to compensate by providing signals to the drivers.

It is still a further object of the present invention that the signals it provides be intuitive to drivers.

It is still a further object of the present invention to provide a traffic control system that is relatively inexpensive to install.

It is still a further object of the present invention to be useful without requiring any vehicle modifications to be made.

These and other objects and advantages of the present invention will become apparent from a reading of the attached specification and appended claims.

SUMMARY OF THE INVENTION

The present invention is a traffic control system that comprises a traffic control strip extending along a traffic lane, detectors positioned at intervals within the traffic control strip, and processors at intervals within the traffic control strip for the purpose of 1) controlling the illumination of a plurality of luminants within the traffic control strip 2) collecting readings from the vehicle detectors, an 3) providing bidirectional communication with higher level traffic control computers.

The traffic control strip has its plurality of luminants extending at spaced intervals along the traffic control strip. The detectors are positioned at spaced intervals along the traffic control strip for the purpose of detecting and optionally receiving signals from or transmitting signals to vehicles passing in proximity to the traffic control strip.

The processor transmits a signal to the luminants so as to create a banded pattern in front of (relative to the direction of traffic flow) the vehicle location deduced from the signals received by the detectors. The traffic control strip extends near the center of the traffic lane, perhaps offset to be directly in front of the typical driver. Specifically, the traffic control strip is a clear strip of solid material affixed to the surface of the traffic lane. This clear strip is made of a polycarbonate material having a thickness of less than one-half of an inch. Electrical and/or optical transmission lines extend through the traffic control strip so as to connect the plurality of luminants and the detectors with the processors, and such lines extend to roadside boxes where they connect to supervisory traffic control computers and power supplies.

The luminants are a linear array of light emitting diodes extending along the length of the traffic control strip. The detectors consist of a plurality of infrared transmitters and receivers positioned at regular intervals along the traffic control strip. These infrared detectors are used to resolve the position of vehicles in two ways, first by bouncing infrared light off the underside of the vehicle, or, if the presence of sunlight makes this impossible to detect, by sensing the shadow of the vehicle. In additions, the detectors can sense infrared data transmissions from vehicles equipped with transmitters passing in proximity to the strip.

The present invention also includes an optional transmitter positioned on a vehicle travelling along the traffic control strip. This transmitter passes a signal to the detectors when the vehicle is in proximity to the detectors. The transmitter is positioned on the underside of the vehicle so as to be in close proximity to the detectors and is connected to the turn signal mechanism of the vehicle so as to deliver an infrared signal to the detectors indicative of turn signal activity and direction.

Additionally, a signal receiver may be attached to the vehicle so as to be interactive with the cruise control of the vehicle. The position detection infrared transmitter in the traffic control strip can deliver a signal (ultimately derived from a high level traffic computer) to the vehicle for controlling the speed of the vehicle in response to the traffic flow requirements.

The present invention provides several advantages relative to the control of traffic flow that includes: (1) close resolution of speed and spacing of all vehicles on a section of roadway, (2) high level computer traffic flow optimize, taking into account local (such as vehicle turn signal activity) and more global information, and (3) providing an intuitive signal to drivers as to the optimum speed and spacing of their vehicle, and (in some cases) direct control of vehicle speed through transmission of speedup/slowdown signals to cruise control systems in vehicles.

The first step is accomplished by the plurality of detectors embedded in a strip along a roadway. Periodically vehicle location, and by inference speed, is passed from microprocessors reading the detectors to a higher level computer in communication with similar computers in either direction on the roadway under consideration. The global optimum speed and location is calculated for each vehicle in the higher level computers. Since the vehicles will seldom be exactly where the global optimum indicates they should be error signals will be generated. The error signals are then communicated to the microprocessors in the traffic control strip. The microprocessors by controlling the plurality of luminants extending linearly along the roadway form a flying target dependent on the vehicle speed at a fixed distance leading the vehicle. Within the flying target, data from the higher level computer is used by the microprocessors to cause variable moving patterns to appear in the lighted section of luminants which signal the driver of a particular vehicle to speed up or slow down, or, if the pattern within the lighted section is stationary, to remain at the same speed.

A driver on a road equipped with this invention would see a flying illuminated target at a fixed distance ahead of his vehicle. Within the illuminated target would be light and dark bands which would (seemingly) move at variable rates either toward or away from the driver. Slow movement away from the driver would be a request to the driver to speed up slightly, slow movement toward the driver would mean to slow down sightly. Faster movement would indicate to the driver that his vehicle is further away in speed or spacing from the speed/place where the traffic control computer wants his vehicle. A pattern with no motion within it would serve to tell the driver that his vehicle is exactly in its assigned slot in the traffic flow. The flying target with its contained pattern would be located about 20 degrees down from the drivers' line of sight looking straight ahead. This type of "heads up" display near the center of a driver's vision should not interfere with driving as much as glancing at a speedometer.

Assuming cooperative drivers (somewhat of an assumption), a typical control strategy to improve flow in high density traffic would be the maintenance of lane change opportunities. Having to slow down in the inner lanes of a multi lane highway in order to change lanes is a major cause of stop and go conditions developing. A high level traffic control computer would present frequent lane change opportunities by keeping "holes" open in the traffic, moving the holes backwards in relation to the traffic stream, and creating new holes and closing excess ones as needed. A hole would move backwards through the traffic by drivers being instructed (waved forward by the flying pattern) to move into it while the driver behind was kept in place for a short time. Opening and closing holes in the traffic stream would be accomplished in a similar fashion.

Merge control has been considered by some of the cited inventions, and to some extent is done today with metering light systems which detect the density of freeway traffic. Merge traffic on freeways equipped with the present invention would be instructed through traffic control strips place on the entry ramps to accelerate at a controlled rate into a place within the traffic stream known by the traffic control computer to be open.

Many other high level control and emergency functions would be simultaneously taken into consideration by the traffic control computers.

The method of this invention further includes the optional step of transmitting a signal from the vehicle indicative of activity and direction of the turn signal of the vehicle. This signal, encoding the desired direction, would cause the high level computer to open a hole (by slowdown and speedup signals t o drivers as above) in the traffic in the lane next to the one the signalling vehicle was in, and indicate to the driver requesting a lane change when the hole opening task was accomplished by blinking the flying pattern he was following.

The present method may also include the step of (1) transmitting a signal from the roadway to a detector in the vehicle; and (2) setting the speed of the vehicle in response this transmitted signal. The speed of the vehicle is adjusted by way of the cruise control increase/decrease mechanism of the vehicle. Since the traffic control system would not necessarily know which vehicles were so equipped, a speedup/slowdown signal would be sent to the vehicles in concert with the speedup/slowdown signals presented visually to the drivers.

DETAILED DESCRIPTION OF THE INVENTION

Figure 1:
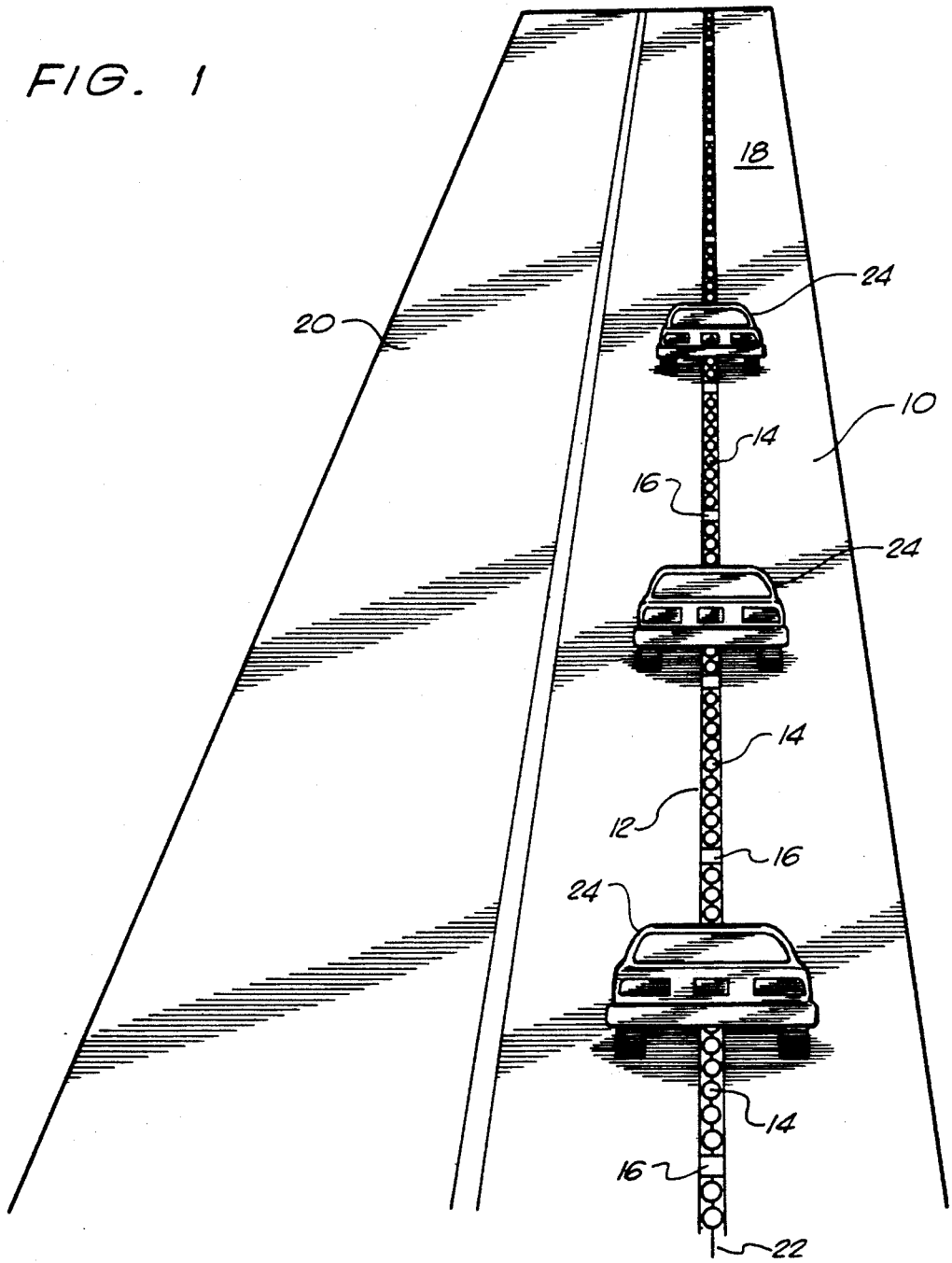
FIG. 1 is an end view, in perspective, showing the configuration of the present invention.

Referring to FIG. 1, there is shown at 10 the traffic control system in accordance with the preferred embodiment of the present invention. As can be seen in FIG. 1, the traffic control system 10 comprises a traffic control strip 12 having a plurality of luminants 14 extending at spaced intervals therealong, detectors 16 positioned on the traffic control strip, and processors (not shown) that receive and transmit signals from and to the traffic control strip 12. As used herein, the term "processor" includes microprocessor in the traffic control strip, higher level computers, and any processors between the two.

The traffic control strip 12 extends along the center of traffic lane 18 on roadway 20. This traffic control strip 12 is a clear strip of solid material affixed, by gluing or other attachment techniques, to the surface of the traffic lane 18. Alternately, in areas where snow must be plowed from roads, the strip can be recessed in a slot cut into the roadway. Specifically, this traffic control strip 12 is a clear strip of a polycarbonate material having a thickness of less than one-half of an inch. Electrical and/or optical control lines 22 are contained within traffic control strip 12 and are connected to the luminants 14 and the detectors 16. Ideally, the traffic control strip 12 is made of a configuration less than one and one-half inches wide and less than one-quarter of an inch thick. The traffic control strip 12 is glued near the center of traffic lane 18. It may also be offset slightly so as to be directly in front of the typical driver.

The luminants 12 are placed in a linear array extending for the length of the traffic control strip 12. The luminants 12 are light emitting diodes that are spaced approximately two inches from each other. Light emitting diodes are inexpensive, rugged, long lived, and interface well with standard logic voltage levels. The luminants 14 are encased in the traffic control strip 12. As can be seen in FIG. 1, vehicles 24 travel along the traffic control strip 12 in accordance with the signal information presented to the driver by and through the luminants 14.

The vehicle detectors 16 are generally placed at five foot intervals along the traffic control strip 12. Typically, the detectors are infrared transmitter/receiver pairs. The close spacing of these detectors 16 provides nearly continuous information on the location of the vehicle, and redundancy if a detector fails. In using the detector 16 of the present invention, the detector strategy will need to be flexible, due to the sunlight sometimes masking the signal from the transmitter. Detection in high light conditions will still be possible by detecting the vehicle's shadow. In addition, infrared diodes provide a communication channel of considerable capacity between the roadway computers and the vehicles. Each of the vehicles 24 may include suitable infrared transmitters for providing information to the infrared detector 16 on the traffic control strip 12, and suitable infrared detectors to receive data from the traffic control strip.

Figure 2:
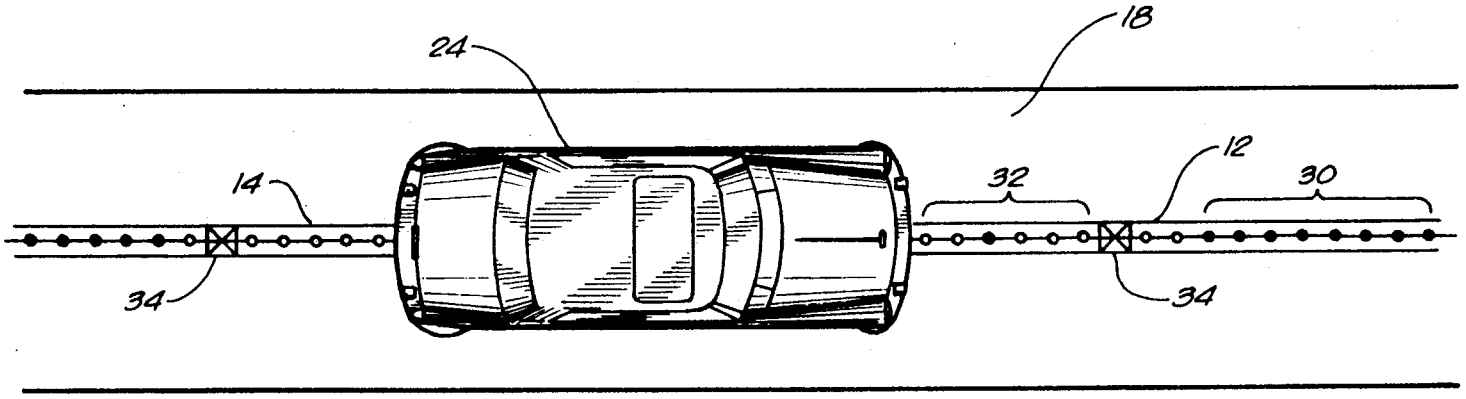
FIG. 2 is a top view showing the relationship of an vehicle with the traffic control strip of the present invention.

Referring to FIG. 2, it can be seen how the vehicle 24 travels along the traffic lane 18 in relation to the traffic control strip 12. On the traffic control strip 12, there are illuminated light emitting diodes 30 and non-illuminated diodes 32. The detectors 34 are suitably spaced along the linear array of luminants 14. As can be seen in FIG. 2, the light emitting diodes 14 are selectively illuminated forming a "flying target" pattern located at a fixed distance in front of the vehicle. Within the pattern, light and dark bands circulate which communicate to the driver as discussed above how he should adjust his speed.

The position of the vehicle will be detected by the interaction of the vehicle as described above with detectors 16.

Figure 3:
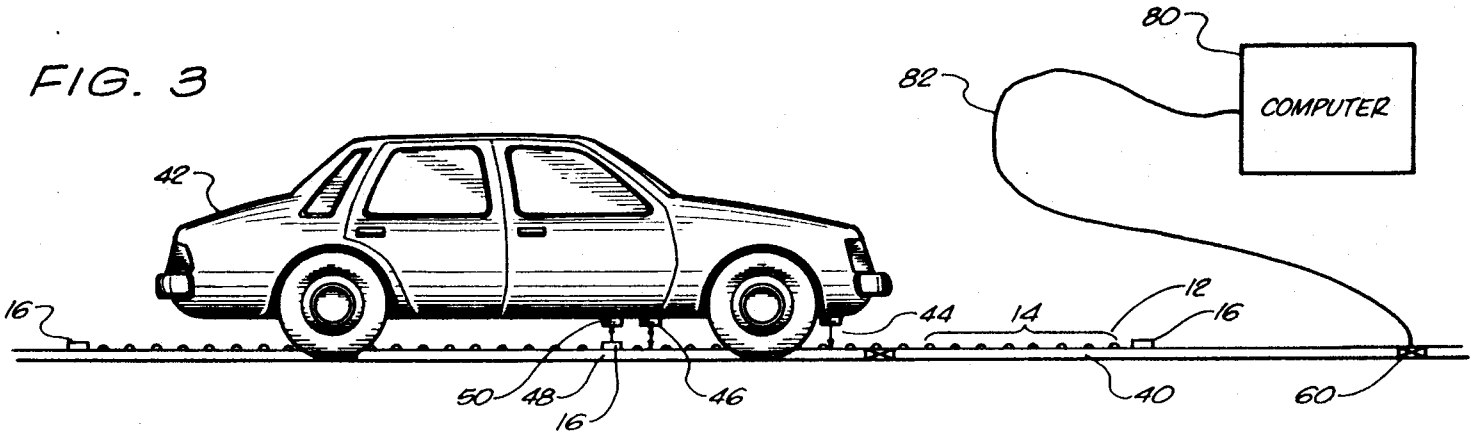
FIG. 3 is a side view showing the interactive relationship between the vehicle and the traffic control strip of the present invention.

Referring to FIG. 3, it can be seen that the traffic control strip 12 is affixed to the roadway surface 40. The vehicle 42 travels along the traffic control strip 12 in the manner indicated. The detectors 16 are positioned at regular intervals along the traffic control strip 12. The light emitting diodes 14 extend for the length of the strip so as to provide a signal to the driver of vehicle 42.

In the embodiment illustrated in FIG. 3, the infrared radiation from transmitter/receiver pairs 16 in the traffic control strip will be reflected from underside of vehicle 42, and will impinge onto receiver of transmitter/receiver pairs 16, resulting in an electrical signal which is read by microprocessor 60 embedded in the traffic control strip 12 through optical or electrical lines built into the traffic control strip 12. Detector signals are then passed to traffic control computer 80 over optical or electrical signal lines 82.

Because of the possible presence of sunlight on the detectors, a flexible detection strategy will be required. Signal levels from each detector will be read at frequent intervals, both with, and without the infrared transmitter operating. The presence of a vehicle 42 would be determined in traffic control computer 80 by changes in detector 16 levels either due to reflected infrared, or decreased sunlight. The detectors provide nearly precise location at frequent intervals from which vehicle speed may be calculated. In addition, the length of the vehicle can be closely estimated. Longer vehicles are almost always trucks, and this information would be useful to the high level traffic control computers, for example, the distance between the vehicle and the illuminated pattern should be increased to compensate for the higher position of the driver over the roadway.

It is also possible to incorporate a turn signal transmitter 46 onto the vehicle 42. This turn signal transmitter 46 is connected to the turn signal mechanism of vehicle 42. The turn signal transmitter 46 will transmit a signal to any of the receivers of detectors 16 of the direction of the turn signal. This indicates to the traffic control computer that the driver of the vehicle 42 desires to change lanes in a particular direction. By manipulating the location of the vehicles in the adjacent lane (as described above) the traffic control computer would cause a gap to form in the traffic lane into which the driver wants to move. Once the gap has been opened, the driver would be informed of this fact by blinking the light pattern that the driver is following. It is also possible that a voice or other audible indication that a lane change space had been opened, could be transmitted to drivers of vehicles equipped to receive such signals.

Another element of the system is suitable for vehicles equipped with cruise controls. In this system transmitters of transmitter/receiver pairs in detectors 16 are used to send data to receiver unit 50 mounted on the underside of vehicle 42.

This data link can be used to provide speed up or slow down commands to the vehicle. Typical cruise controls on vehicles come with "bump up" and "bump down" which increase or decrease the speed setting by a fraction of a mile-per-hour per operation.

Of course, neither the turn signal transmitter 46, nor the cruise control link, is required for the present invention to operate. These features are optionally installed in vehicles by drivers who regularly use roads equipped with traffic control strips. In this embodiment, the traffic control strip provides a great deal of convenience to the drivers.

Figure 4:
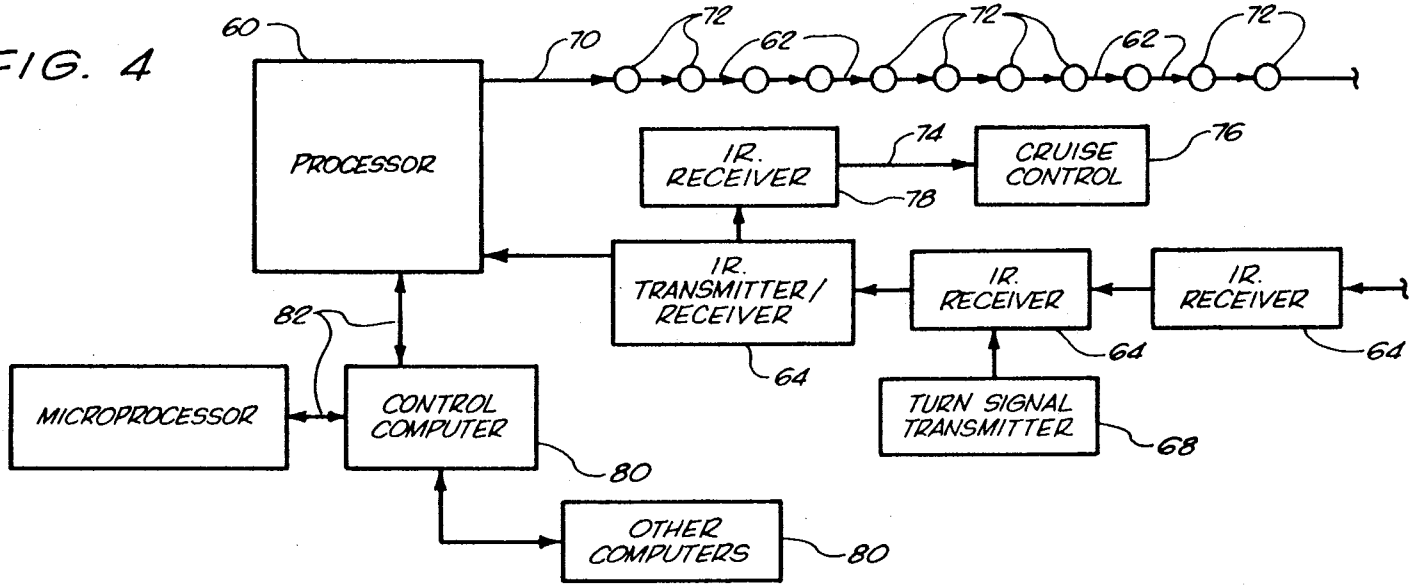
FIG. 4 is a block diagram illustrating the operation of the present invention.

FIG. 4 shows a block diagram representation of the operation of the present invention. Reading from detectors 64 are passed through microprocessors 60 to traffic control computer 80 via optical or electrical data lines 82. In traffic control computer 80 vehicle speed and location from many vehicles are process inputs to a traffic control program concerned with this particular linear extent of roadway. In addition to the data inputs from the microprocessors 60 to which traffic control computer 80 is directly connected to, a particular traffic control computer would be receiving data from the direction of approaching traffic, and would be sending information about the traffic about to leave its area of concern to the traffic control computer 80 "downstream", while "downstream" traffic control computers would be sending messages concerning traffic conditions in the area of their primary concern (the section of traffic control strip to which they were directly connected.)

Given all these inputs, a traffic control program within the traffic control computer 80 compares the vehicle actual location and speed with that desired for optimal vehicle throughput. Output from the traffic control computer to the drivers is in changes to the direction and rate of the circulation of the patterns seen by each driver. Specifically, if a vehicle was measured to be ahead of the location determined by the traffic control computer to be best for traffic throughput, the microprocessor controlling the luminants would be sent a message to circulate the pattern toward the vehicle, indicating to the driver that he should slow down. Similarly, if the vehicle was behind the location determined by the traffic control computer to be best for traffic throughput, the microprocessor controlling the luminants would be sent a message to circulate the pattern away from the vehicle, indicating to the driver that he should speed up, after, of course, checking that there was space in front of the vehicle.

It can be seen that computer 80 receives information from the microprocessors and from peer computers controlling traffic in other sections along the roadway and from computers controlling traffic in adjacent lanes.

In response to traffic conditions, computer 80 sends messages to peer computers. Computer 80 also sends messages to the microprocessors 60 in the traffic control strip providing them with "pattern circulation" settings, and "pattern leading" distances for each vehicle, and a setting for the speed of propagation for each vehicle of the lighted sections of the luminants 72. Luminants 72 are activated to provide the desired target and signal to drivers through electrical or optical lines 70 by microprocessor 60. Microprocessor 60 also reads detectors in infrared transmitter/detector pairs 64 over optical or electrical data lines 62. Infrared detectors are also read through data lines 62 to detect the operation of optional turn signal transmitters 68 mounted on vehicles. Infrared transmitters are also used to signal optional infrared speed control receivers 78 mounted on vehicles. "Speed up/slow down" signals are sent to the vehicle'cruise control system over signal lines 74.

The above described invention, with the object of bringing freeway traffic under detailed control, opening holes for lane change opportunities, and adjusting the speed/spacing of all vehicles requires three different interactive components. First, it is necessary to detect the position of each vehicle in the traffic stream essentially continuously. The infrared transmitter/detectors in the traffic control strip have this function, though other methods, such as magnetic detectors, would suffice.

Second, there is a requirement for a massive amount of computation (roughly the equivalent of one large personal computer per lane per mile) to make a myriad of decisions taking account of global, local, and micro traffic conditions. Only recently has the cost/performance of small computers reached an acceptable cost level.

Third, there must be a method for the computer to continuously tell the drivers where they should be in the traffic streams. Light emitting diodes spaced two inches apart and operated by dedicated microprocessors embedded in the traffic control strip are proposed in the present invention.

The close spacing of the light emitting diodes will present drivers with an essentially continuous signal down to quite low speeds. At sixty miles per hour or eighty-eight feet per second, the driver would see over five hundred individual light sources per second. Visual flicker should become apparent only at speeds below 10 mph.

There is not enough information in a lighted target flying down a road. If drivers are supposed to follow the pattern, and the pattern runs off into the distance, what do they do? Perhaps this is why the long proposed pacing systems have never been widely installed. The solution proposed in this invention is a pattern of light and dark bands in the lighted target which circulate within the target to provide speed up or slow down signals to the drivers by the pattern seeming to crawl away from them or toward them.

A substantial part of this invention is the multifaceted traffic control strategy. One example is similar to "conduction by holes" in semi-conductors. A very significant problem in high density traffic is lane changing. When an exit is coming up, one must get to the proper lane to make the exit. If there is no space next to the driver, the driver must move relative to the traffic in that lane until the driver can find a space. In high density traffic, moving forward is almost always impossible, so the driver drops back, forcing the vehicle behind the driver to slow down, or crash into the driver. This effect often propagates back along the stream of traffic until complete stoppage results, especially when twenty or thirty other drivers are trying to do the same thing. The proposed strategy would be to keep holes open in the traffic so that frequent lane change opportunities are presented to each driver.

The holes need to move (relative to the traffic stream) to present these frequent opportunities, so the computer would implement a game of highway leapfrog, where space is propagated backwards through the traffic stream. A driver would see the vehicle in front of him pull up, while he was kept in his place by his target pattern. If the hole was not used in a short time, he would be given instruction to move up, and the empty space would be presented to other drivers.

Holes which are used disappear, while holes are created in the lanes driver has left. It would be a major task of the traffic control computers to reorganize the holes closing up some and opening up others to maintain frequent (uniformly spaced) lane change opportunities.

Most of the design of the present invention has been directed toward freeway/expressway use. Such a system can also be used on heavily travelled surface streets with major modifications, especially to the control strategies. The goal of a surface street installation would be to adjust the speed/ spacing and platoon length of groups of vehicles so that each group would hit all cross street lights "on the green." Such a system would require a programming effort much larger than the relatively simple job of controlling freeway traffic, and possibly may have to await the development of more powerful computers. One modification to the guide strips would be required, side facing LED's of red or green indicating that uncontrolled traffic was free to enter, or should wait until it could be accommodated, that is attached to the front or end of a group of vehicles on the controlled roadway.

This invention is conceivable only because the cost of computation has dropped precipitously in the last decade. The computational capacity of a very large and expensive mainframe computer a decade ago is now available in a personal computer. The cost of building roads (never low) has gone up relative to other expenses, partly due to the environmental conditions.

The present invention proposes a method to use computers to relieve highway congestion and, since a high fraction of pollution is the result of slow or idling vehicles, to improve air quality.

The foregoing disclosure and description of the invention is illustrative and explanatory thereof, and various changes in the method steps, as well as in details of the illustrated apparatus may be made within the scope of the appended claims without departing from the true spirit of the invention. The present invention should be limited by the following claims and their legal equivalents.

I claim:

1. A traffic control system comprising:

a traffic control strip extending along a traffic lane, said traffic control strip having a plurality of luminants extending at spaced intervals along said traffic control strip;

detector means positioned on said traffic control strip so as to detect a vehicle in said traffic lane, said detector means comprising a plurality of infrared transmitter/detectors positioned at regular intervals along said traffic control strip, said infrared transmitter/detectors for detecting infrared reflections from a vehicle; and processor means connected to said detector means and said plurality of luminants in said traffic control strip, said processor means for creating a signal pattern in said plurality of luminants relative to vehicles as detected by said detector means.

2. The system of claim 1, said traffic control strip extending along the center of said traffic lane.

3. The system of claim 1, said traffic control strip being a clear strip of solid material affixed to the surface of said traffic lane.

4. The system of claim 3, said clear strip being of a polycarbonate material having a thickness of less than one-half of an inch.

5. The system of claim 1, said traffic control strip being recessed into the surface of said traffic lane.

6. The system of claim 3, said traffic control strip having electrical transmission lines extending therewithin, said electrical transmission lines connected to said plurality of luminants, said detector means, and said processor means.

7. The system of claim 3, said traffic control strip having optical transmission lines contained therewithin, said optical transmission lines connected to said plurality of luminants, said detector means, and said processor means.

8. The system of claim 1, said plurality of luminants comprising light emitting diodes visibly positioned in a linear array in said traffic control strip.

9. A traffic control system comprising:

a traffic control strip extending along a traffic lane, said traffic control strip having a plurality of luminants extending at spaced intervals along said traffic control strip;

detector means positioned on said traffic control strip so as to detect a vehicle in said traffic lane;

transmitter means attached to said vehicle for transmitting a signal to said detector means, said detector means having a receiver suitable for receiving said signal as transmitted by said transmitter means; and processor means connected to said detector means and to said plurality of luminants in said traffic control strip, said processor means for creating a signal pattern in said plurality of luminants relative to the vehicle as detected by said detector means.

10. The system of claim 9, said detector means positioned at regular intervals along said traffic control strip, said luminants aligned between said detector means in a linear array.

11. The system of claim 9, said detector means comprising a plurality of infrared transmitter/detectors, said transmitter/detectors for transmitting an infrared signal and detecting the reflectance of the transmitted infrared signal.

12. The system of claim 9, said transmitter means comprising:

a transmitter positioned on the underside of said vehicle so as to be in close proximity to said detector means.

13. The system of claim 12, said transmitter connected to the turn signal mechanism of said vehicle, said transmitter for delivering an infrared signal to said detector means relative to the direction of the turn signal of said vehicle.

* * * * *